United States Patent [19]

Rollings

[11] 4,066,316

[45] Jan. 3, 1978

[54] ELECTRICAL CONNECTOR CONSTRUCTION

[75] Inventor: Robert William Rollings, Auburn, Ala.

[73] Assignee: Bell Telephone Laboratories, Incorporated, Murray Hill, N.J.

[21] Appl. No.: 740,843

[22] Filed: Nov. 11, 1976

[51] Int. Cl.[2] ..... H01R 9/08; H01R 13/54

[52] U.S. Cl. ..... 339/91 R; 339/97 R

[58] Field of Search ..... 339/91 R, 75 MP, 96–99, 339/17 F, 176 MF

[56] References Cited

U.S. PATENT DOCUMENTS

| | | | |
|---|---|---|---|
| 3,820,055 | 6/1974 | Huffnagle et al. | 339/97 P X |
| 3,993,393 | 11/1976 | Worth | 339/99 R |

*Primary Examiner*—Joseph H. McGlynn
*Assistant Examiner*—E. F. Desmond
*Attorney, Agent, or Firm*—William H. Kamstra

[57] ABSTRACT

A multipart electrical connector construction comprising a conductor mounting plug adapted for insertion in a slotted cavity of a receptacle housing. The housing carries a plurality of contact terminals which at one end provide sockets for receiving backplane terminal pins, for example. At the other ends, and within the housing cavity, the contact terminals are formed to present insulation cutting blades. The plug is provided with a plurality of fingers for maintaining conductors therebetween in registration with the receptacle housing terminal blades, the insulation of the conductors being pierced and electrical contacts made as the plug is inserted in the housing cavity. A feature of the connector construction is an upturned spring tab on each of the contact terminals for guiding the plug fingers upwardly so that pawls provided at the finger ends engage a detent lip of a recess in one wall of the cavity housing for "snap-in" locking of the plug, the spring tab also preventing its inadvertent removal.

13 Claims, 4 Drawing Figures

ELECTRICAL CONNECTOR CONSTRUCTION

BACKGROUND OF THE INVENTION

This invention relates to electrical connector assemblies and more particularly to such assemblies adapted to facilitate the connection of multiconductor cables to corresponding connector contact terminals.

The communications and electronics fields have in recent years seen many technical advances resulting in reduced cost and power requirements, greater facility for miniaturization, simplified installation and maintenance, and other advantages. Integrated circuits, printed wiring boards, including multilayer boards and the like, for example, have contributed extensively to system simplification and savings in the time required for installation, testing, maintenance, and to overall reliability. The interconnection between system components and mounting frames, on the other hand, still relies largely on individual wires assembled in cables for power distribution and signal transmission. In most systems, terminations from the many circuit units are collected on a common backplane and appear as large fields of densely packed pins to which the conductors of interconnecting cables must be joined. Although the art has offered improvements in connectors designed to achieve the electrical connection between such backplane pins and individual cable conductors, the problems of facilitating and speeding the individual joining of the conductors and connector terminals remain. In many connector assemblies, the electrical joining is accomplished by individually soldering each cable conductor to a corresponding contact terminal of the connector. In an alternate method known in the art, electrical connection between the connector terminals and the cable conductors is achieved by slicing through the conductor insulations by means of bifurcated blades extending from the terminals, which blades at the same time seize the bared conductors to make the connections. The latter method has the obvious advantages that, not only is the tedious and time consuming soldering step eliminated, but the necessity of first stripping the conductors is also avoided.

The individual cable conductors are first sorted and arranged on a first insulated member mounting the conductors in a pattern corresponding to the spacings of terminal blades retained in a second insulated housing member. The two members are adapted to be engaged one by the other, during which engagement the blades function as described to make the electrical connections. After this assembly of the members, a unitary connector plug is realized which then may be manually positioned as required to receive backplane or other terminal pins. It will be appreciated that, in order to achieve a reliable connector plug assembly, the circuit completion elements of the insulated subassemblies must be accurately mated to ensure positive electrical connections and, further, once so mated, the subassemblies must be securely locked together to prevent any loosening of the connections as the result of manual movement of the connector plug, vibration, or temperature changes, for example. At the same time, the assembly must provide for the ready separation of the insulated members in order to permit wiring changes and the repair of electrical connections, should this eventually prove necessary.

It is accordingly one object of this invention to provide a new and novel electrical connector construction which may be speedily assembled and yet ensures a reliable and vibration resistant unitary structure.

It is also an object of this invention to provide an improved conductor terminating plug which permits a high degree of versatility in making electrical interconnections.

Another object of this invention is the provision of a novel electrical connector construction for locking into electrical contact a plurality of conductors and a corresponding plurality of connector contact terminals.

A further object of this invention is to achieve a novel contact terminal which serves not only to complete an electrical connection, but also cooperates to act as a connector assembly locking element.

SUMMARY OF THE INVENTION

The foregoing and other objects of this invention are realized in one specific embodiment thereof comprising a two-part connector assembly in one part of which a plurality of contact terminals are arranged side-by-side in slotted apertures provided therefor in an insulated receptacle housing. At one end, the terminals appear on one face of the housing and there provide sockets to receive backplane or other terminal pins. At their other ends, the terminals are provided with bifurcated blades which lie on a floor of a cavity provided in the housing and protrude from the supporting floor for at least the length of the blade bifurcations. The terminals, during assembly, are individually inserted in the apertures and are locked in place by means of a tab pawl raised on each which, by snap action, engages a detent formed in the housing cavity wall. Alternatively, a detent is not necessary and the tab pawl may simply interfere with and partially embed in the aperture wall as the terminal is inserted.

The second part of the connector construction comprises an insulated comb plug adapted to be inserted in the cavity of the receptacle housing and is provided with a plurality of fingers between adjacent ones of which the individual conductors of a cable are arranged. The conductors are maintained in grooves provided therefor in the comb plug at right angles to the plane of the contact terminal blades of the first subassembly when viewed from the position of the comb plug preparatory to its insertion in the receptacle housing cavity. Assembly of the two-part connector construction is accomplished by the force-fit of the conductor comb plug into the open face of the receptacle housing. During this mating operation, the bifurcated blades of the contact terminals seize corresponding conductors presented between the comb plug fingers and slice through the conductor insulation and into the underlying metal to make the electrical connections. As the comb plug is forced into the receptacle cavity, it is securely locked in place by the engagement of pawls formed at the ends of the comb fingers and a detent lip of a slot provided in the cavity ceiling.

According to one feature of a connector construction according to this invention, the locking together of the two-part assembly is further ensured by a spring tab raised on the upper surface of the blade portion of each contact terminal. As a corresponding comb plug finger is moved into the receptacle cavity, its lower surface flexes the tab downward by spring action. When the finger pawl passes the ceiling detent lip, the terminal spring tab forces the pawl into engagement with the lip and securely holds it there. The two-part assembly may be separated by forcing the comb fingers inwardly against the spring action of the terminal spring tabs to free the finger pawls out of engagement with the receptacle cavity ceiling lip after which the comb plug may be withdrawn from the receptacle housing. Means for ensuring optimum contact pressure on terminal pins inserted in the contact terminal sockets are also provided. The sockets are formed by a pair of opposing contact blades at the ends of the contact terminals. As a contact terminal is fitted into its housing aperture, the contact blades are separated a distance as determined by the terminal pin dimensions by a pair of ribs extending from opposing walls of the terminal aperture. The tensioning of the contact blades is thus adjusted to achieve the optimum pin contact pressure.

In order to summarize a description of an illustrative connector construction according to this invention, a connector arrangement providing a single row of contact terminals has been considered. It will be appreciated that a connector of greater capacity may be realized by providing an additional row of contact terminals and such a construction will be described in greater detail hereinafter. Briefly, such a construction is readily achieved in a receptacle housing providing a second cavity and slotted terminal apertures, the contact terminals being inserted in positions inverted from those of the terminals of the adjacent row. A second row of fingers between adjacent ones of which additional conductors may be arranged is provided on the comb plug. The finger pawls are oppositely directed from the pawls on the adjacent fingers to engage the detent lip of a slot provided in the opposite wall of the housing cavity.

Another feature of this invention is thus a double-sided connector plug construction which may be wired without regard to connector sides. Advantageously, the plug sides are further arranged so that the conductors may be selectively inserted all from either side or selectively in particular groups from both sides. The speedy assembly of the connector is thus significantly enhanced.

It is also a feature of a connector assembly according to this invention that the conductors, when mounted from either side of the connector plug, are arranged at right angles from the cable direction. As a result, the conductors are prevented from being withdrawn and from exerting any force on the electrical contacts of the terminal blades should the cable be pulled or twisted.

A second advantage of the right-angle disposition of the conductors mentioned in the foregoing and which constitutes still another feature of a connector according to this invention is the fact that the conductors may be selectively extended at both sides of the connector plug beyond its upper and lower surface. The extended conductors are thus available for making other desired electrical interconnections.

BRIEF DESCRIPTION OF THE DRAWING

The foregoing and other objects and features of this invention will be better understood from a consideration of the detailed description of the organization and assembly of one illustrative embodiment thereof which follows when taken in conjunction with the accompanying drawing in which.

DETAILED DESCRIPTION

Figure 1:
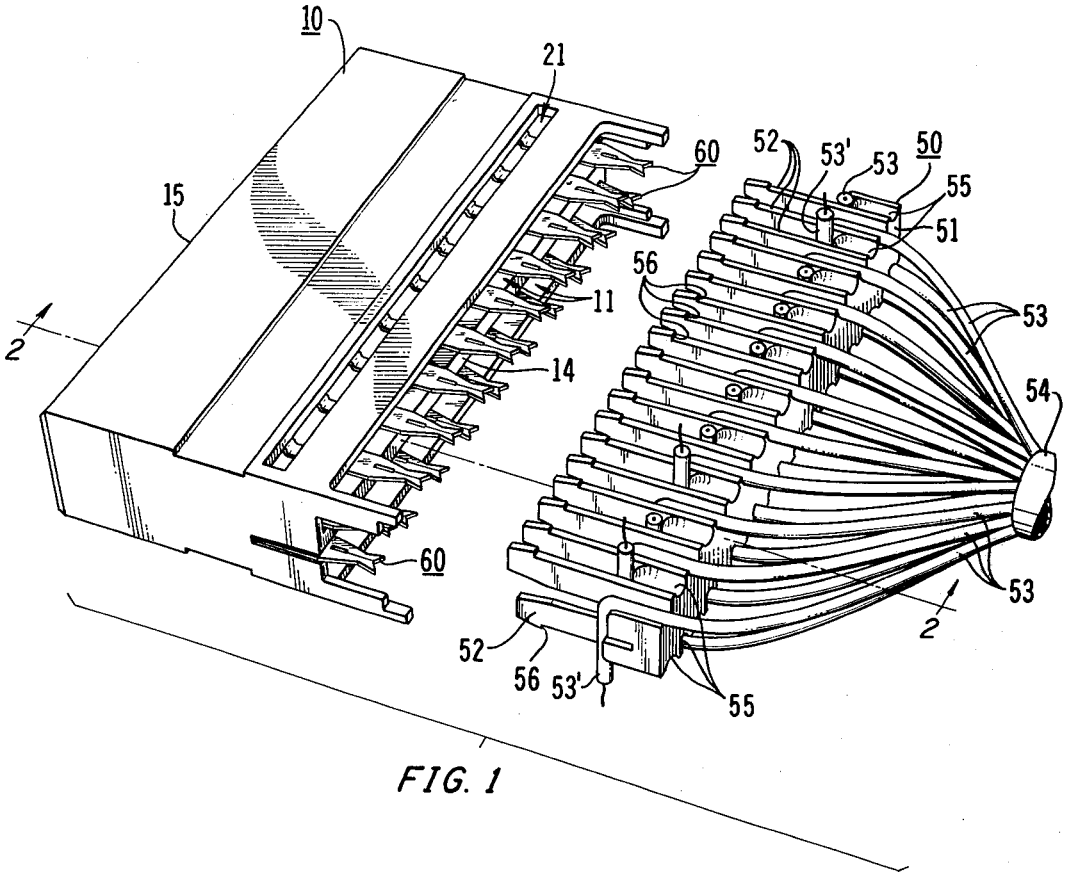
FIG. 1 is a perspective view of one specific two-part connector construction according to the principles of this invention, the parts being shown in the fabrication stage just prior to final assembly.

An illustrative electrical connector construction according to this invention is shown in FIG. 1 in its stage of fabrication just prior to final assembly, the construction comprising a receptacle housing 10 and a comb plug member 50, both formed of any suitable electrical insulating material known in the art. The housing 10 is a generally box-like structure. A first face of the housing 10, not visible in FIG. 1, comprises the operative face of the connector construction and presents the ends of contact terminals into which the terminal pins of a backplane or other pins my be inserted, as will be more clearly seen in the section view of FIG. 2 to be considered. A second, opposite face of the housing is opened to present a slotted cavity 11 dimensioned to receive the plug member 50 in the final assembly step.

The comb plug member 50 comprises a base 51, from which is extended at right angles a double row of substantially flat, equally spaced fingers 52, shown in FIG. 1 preparatory to their insertion into the cavity 11 of housing 10. The plug member 50 is adapted to receive and arrange the individual conductors 53 of an electrical cable 54, a portion of which is shown in the drawing. Thus, in the illustrative connector construction being described, half of the conductors 53 of cable 54 are arranged in grooves 55 provided therefor in the upper surface of base 51 between first alternate adjacent fingers 52 of the upper row, the other half of the conductors 53 being arranged in identical grooves 55 provided therefor in the undersurface of base 51 between second alternate adjacent fingers 52 of the lower row. The conductors 53 arranged on the upper side of base 51 are bent downwardly and maintained at right angles to their direction in the grooves 55 between adjacent fingers 52, and the conductors 53 arranged on the underside of base 51 as viewed in the drawing are bent upwardly and similarly maintained at right angles to their directions as disposed in the grooves 55 between adjacent fingers 52.

Although the conductors 53 are shown in an exemplary arrangement in FIG. 1 as alternating between the upper and underside of base 51 in the direction of insertion between the fingers 52, the invention is not so limited. Indeed, as mentioned hereinbefore, it is a feature of the invention that all of the conductors may be inserted from either side or a selected number of the conductors 53 may be inserted from each side. This versatility advantageously makes possible a significant reduction in the assembly time of a connector according to this invention. Moreover, although the conductors 53 may be merely cut to length without the necessity of stripping the insulation at their ends, all of the conductors 53 or a selected number of them may extend beyond the fingers 52 and thereby be available for making additional circuit interconnections. Exemplary such extensions are represented in FIGS. 1 and 2 by extended conductors 53'.

Each of the fingers 52 is slightly tapered at its end and is provided with an outwardly extending pawl 56, the pawls 56 of the two rows thus extending outwardly in opposite directions. The comb plug member 50 maintaining the conductors 53 as thus described is adapted, as mentioned in the foregoing, to mate with the receptacle housing 10 during which the novel assembly locking and electrical interconnection operations are accomplished. A cross-section view of the assembled two-part connector construction of FIG. 1 is shown in FIG. 2 where one of the upper conductors 53 is also shown after its connection with a contact terminal 60 comprising an element of receptacle housing 10. One of the contact terminals 60 according to this invention is shown in FIG. 3 and comprises an initially flat elongated strip of an electrically conductive material folded for part of its length at one end to present a substantially "U" shaped cross-section having an opening to one side. Separate and individual upper and lower contact blades 61 and 62 are formed, by cutting away a portion of the base of the "U" shaped fold and by tapering the end of the terminal 60. The side wall of the latter fold is further formed to present a tab 63 raised outwardly to the side from the latter wall. The blades 61 and 62 are curved slightly inwardly toward each other to make contact; after the contact point each blade curves slightly outwardly. As will appear hereinafter, the inner surfaces of the contact blades 61 and 62 constitute a socket for a backplane or other terminal pin.

The other end of contact terminal 60 is bifurcated to form two insulation piercing blades 64 and 65, the blade 64 being off-set from the main axis of the terminal 60. The blades 64 and 65 thus formed are sharpened for a partial length of the bifurcation to present opposing cutting edge 66 and 67. The end faces of the blades 64 and 65 are tapered inwardly to present a substantially "V" shaped access 68 to guide and facilitate the entry of a conductor 53. Beyond the cutting edges 66 and 67 the bifurcation is widened to present a slot 69 which permits a spring action separation of the blades 64 and 65 as a conductor 53 is admitted. The tapered configuration of the sides of blades 64 and 65 opposite to the cutting edges 66 and 67 facilitate a repeatable spring action independent of the number of insertions of a conductor 53. The contact terminal 60 is finally formed at the end under consideration to provide a tab 70 extending outwardly from blade 65, the tab 70 being severed from blade 65 for a part of its length and slightly raised in the direction of the upper contact blade 61 to provide a tab spring 71. The contact terminal 60 is slightly off-set substantially at its midpoint in the specific embodiment being described to conform to the inner contours of housing 10 in which it is adapted to be fitted. The contact terminals 60 appear in the view of FIG. 1 only to the extent that their access faces are visible in the open cavity 11 of housing 10. The manner in which the terminals 60 are fitted into the receptacle housing 10 as well as the features of the interior of the latter housing are better seen in the cross-sectional views of FIGS. 2 and 4.

Figure 2:
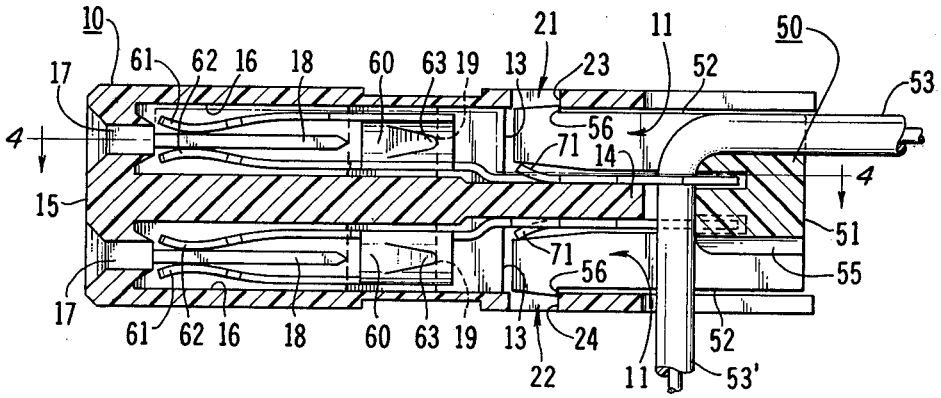
FIG. 2 is a cross-section side view of the connector construction of FIG. 1 as finally assembled taken along the line 2—2.
Figure 3:
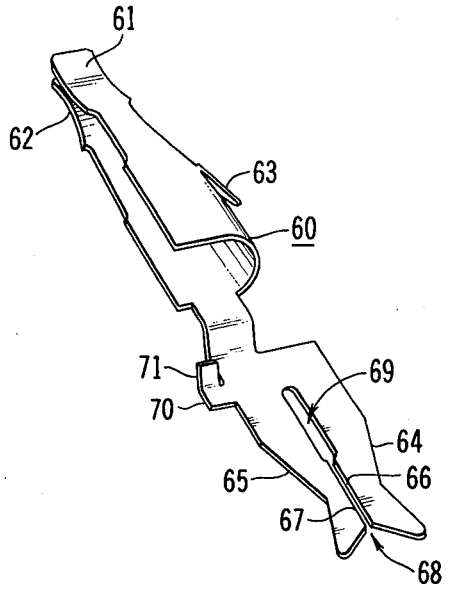
FIG. 3 is a perspective view of a connector contact terminal according to this invention.
Figure 4:
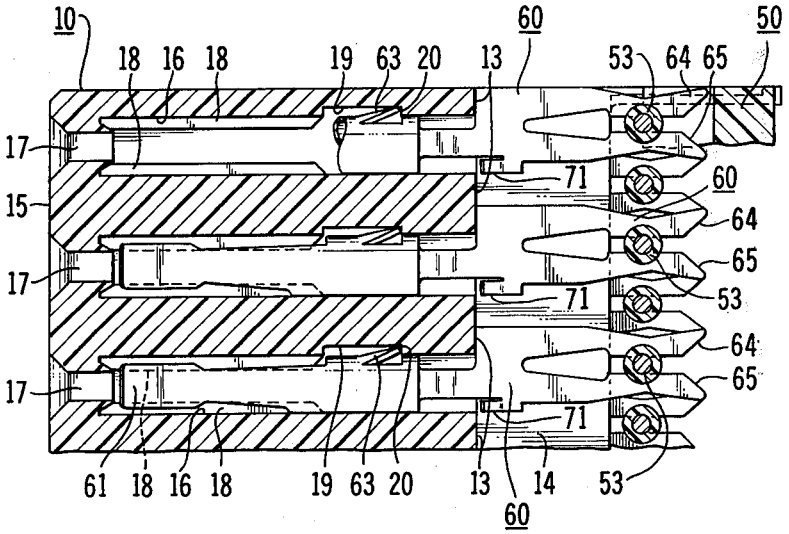
FIG. 4 is a cross-section plan view of a portion of the connector construction of FIG. 1 as finally assembled taken along the line 4—4 in FIG. 2.

As shown in FIGS. 2 and 4, the slotted cavity 11 extends inwardly from the open side of housing 10 to an inner wall face 13 having extending outwardly and centrally therefrom a shelf 14 along the long dimension of slotted cavity 11. Extending from the wall face 13 above and below the shelf 14, as viewed in the drawing, to the pin receiving face 15 of housing 10 are a plurality of slotted apertures 16 dimensioned to receive the contact terminals 60. At the face 15 of housing 10, the apertures 16 are reduced in size to form guide channels 17 dimensioned to slidably admit and guide terminal pins, not shown, into the contact terminal 60 sockets. To further facilitate the entry of terminal pins, the channels 17 (which may be square in cross-section) are chamfered at the housing face 15. Extending inwardly on each side wall of each aperture 16 from a guide channel 17 and along its axis is a rib 18 which projects from an aperture 16 side wall just short of the channel 17 side wall. The projection of the ribs 18 is more clearly seen in FIG. 4 where a portion of a contact terminal 60 is broken away to show the structural details. In this view is also shown recess 19 formed in one side wall of each aperture 16 to which recess each of the ribs 18 extends. The rear edge of each recess 19 presents a detent lip 20. In an alternate construction not shown in the drawing, recess 19 extends to face 13 and no detent lip 20 is formed. As will appear hereinafter, either construction will cooperate with the contact terminal 60. A pair of slots 21 and 22 are cut through the upper and lower walls of the housing 10, as viewed in the drawing, along its longer dimension presenting on the inside second detent lips 23 and 24, respectively. In the cross-section view of FIG. 4, where apertures 16 of only the upper row are shown, the recesses 19 and detent lips 20 are formed on the right walls of apertures 16 viewed as facing the direction of housing face 15. As viewed in the same direction, corresponding recesses and detent lips are presented in the left walls of apertures 16 in the lower row. With the foregoing description of the interior of housing 10 in mind, the installation of the contact terminals 60 may now be considered.

The contact terminals 60, blades 61 and 62 forward, are inserted at the cavity 11 end of housing 10, the bifurcated blade ends lying flat on the floor of shelf 14, considering the upper row as shown in FIGS. 2 and 4. As a terminal 60 is inserted, its blades 61 and 62, initially in contact, are separated by the ribs 18 as the terminal 60 is moved forward into place. During this movement, the pawl tab 63 is flexed inwardly by the side-wall of the aperture 16 until, by spring action, it is snapped into place in a recess 19 and into engagement with a detent lip 20 where such a lip is provided in the construction. In a possible alternate arrangement where the recess 19 extends to face 13, pawl tab 63 gouges and partially embeds in the side-wall of recess 19 as the assembly is made. A contact terminal 60 is now securely positioned in an aperture 16 and is prevented from withdrawal by the pawl tab 63 and detent lip 20 or, alternatively, by the embedded edge of pawl tab 63 in the side-wall of recess 19 where no detent lip is provided. The socket blades 61 and 62 of each terminal 60 are also separated by ribs 18 by a distance as predetermined to ensure their proper tensioning and optimum pressure on inserted terminal pins. In the lower row of housing 10, the terminals 60 are similarly installed in their apertures 16 and, viewing the housing 10 as inverted during the installation, it is apparent from the cross-section view of FIG. 2 that the disposition of the various terminal projections, tabs, etc., as well as the interior configuration of the apertures 16 will be identical to that described in the foregoing for the upper row. The arrangements of the elements of the upper row of housing 10 are thus the reverse of those of the lower row. As a result, the off-set blades 64 of the contact terminals 60 cause a staggered presentation of the bifurcation accesses 68 at the housing 10 cavity 11.

With the contact terminals 60 in place in both rows of apertures 16 as described and as assumed in FIG. 1, the receptacle housing 10 unit is now prepared for the final assembly step of receiving the comb plug 50 subassembly. After proper alignment is ensured, the latter subassembly is forcibly inserted in the cavity 11 of housing 10 resulting in the final assembly shown in cross-section in FIGS. 2 and 4. As the comb plug member 50 is inserted, its fingers 52 are guided by their tapered ends to the left and right sides of the blades 65 of the contact terminals 60 of the upper and lower rows, respectively, into contact with the raised springs 71. The latter springs are deflected in the direction of the shelf 14 by the tapered ends of the fingers 52, the springs 71, as a result, urging the finger 52 pawl ends 56 outward and, finally, into engagement with the detent lips 23 and 24 of slots 21 and 22, respectively. At this point the springs 71 restore to their normal unflexed state and ensure the engagement of the finger pawls and detent lips and, thereby, the permanent and positive union of the two subassemblies. This positive locking of the two subassemblies is achieved without the necessity of providing a locking spring 71 for each of the fingers 52; such a spring 71 is accordingly provided at only one side of a terminal bifurcated blade end. As a result, only alternate fingers 52 of each row are locked in place, although it will be appreciated that a construction providing a pair of locking springs for each contact terminal in order to lock each finger 52 is readily realizable.

The electrical interconnections of the conductors 53 and the contact terminals 60 are accomplished as the two subassemblies 10 and 50 are joined. As the terminal accesses 68 meet the conductors 53, the cutting blades 64 and 65 of each terminal 60 separate to admit the insulation of the conductors to the cutting edges 66 and 67. Cutting through the insulation and into each underlying metal conductor achieves a positive and reliable electrical connection without the necessity of first stripping the conductor ends. The slot 69 in each terminal 60 makes possible a spring action of the blades 64 and 65 for firmly clasping the bared conductor as demonstrated in FIG. 4 where the terminal blades 64 and 65 are shown in their final, slightly spread state. The tapered configuration of the sides of blades 64 and 65 opposite to the cutting edges 66 and 67 additionally facilitate a repeatable spring action of the blades 64 and 65 independent of number of insertions of a conductor 53. In this manner a reliable electrical connection between terminals 60 and conductors 53 is achieved even in the event that receptacle 10 and comb plug 50 are disassembled and reconnected a number of times.

With the two subassemblies 10 and 50 thus mated, an important feature of this invention mentioned hereinbefore is readily apparent. The direction of the conductors 53 as held between the blades of contact terminals 60 is at right angles to their assembly in the cable 54. As a result, conductors 53 are prevented from being accidentally withdrawn from or exerting any force on contact blades 64 and 65 should cable 54 be pulled or twisted.

Should it ultimately become necessary to separate the two connector subassemblies, the finger 52 pawl ends 56 may be disengaged from the detent lips 23 and 24 by simultaneously moving the finger ends inwardly against the spring action of the tab springs 71 through the slots 21 and 22. When the finger pawl ends are thus disengaged, the plug member 50 is readily removable from the housing 10, which will also sever the electrical connections between the terminals 60 and conductors 53.

What has been described is considered to be only one illustrative connector construction according to the principles of this invention and it is to be understood that various and numerous other arrangements may be devised by one skilled in the art without departing from the spirit and scope of the accompanying claims.

What is claimed is:

1. An electrical connector construction comprising a receptacle housing having a first face and a second, opposite face and a slotted cavity opening on said first face, said housing further having a plurality of apertures extending from said cavity to said second face and a recess in a wall of said housing transverse to and within said cavity to present a detent lip; a plurality of electrical contact terminals fitted respectively in said apertures, each of said terminals presenting a terminal pin socket at said second face and a bifurcated conductor seizing blade at said first face; and a comb plug member dimensioned for insertion in said housing cavity, said plug member having a plurality of fingers extending therefrom for positioning conductors therebetween in registration with said conductor seizing blades, each of said fingers being terminated in a pawl, each of said contact terminal blades further having a tab spring extending therefrom for urging toward and locking into engagement, one of said finger pawls with said detent lip as said plug member is inserted in said housing cavity.

2. An electrical connector construction as claimed in claim 1 in which said comb plug member presents a first and an opposite face, each of said faces presenting a plurality of grooves for arranging said conductors in registration with said fingers in patterns on either or both of said first and opposite faces.

3. An electrical connector construction as claimed in claim 2 in which said conductors are arranged in said grooves in a first direction and are positioned between said fingers in a direction substantially at right angles to said first direction.

4. An electrical connector construction as claimed in claim 3 in which each of said conductor seizing blades of said contact terminals comprises a pair of opposing cutting edges for receiving and cutting through the insulation of an electrical conductor and into electrical contact with the conductor metal.

5. An electrical connector construction as claimed in claim 4 in which at least one of said conductors extends beyond one of said first and opposite faces for electrical interconnection external to said connector construction.

6. An electrical connector construction as claimed in claim 5 in which said recess within said housing cavity extends through said housing wall for providing access to said plug member fingers.

7. A contact terminal construction for a two-part electrical connector comprising an elongated flat strip of an electrically conductive material, said strip having a bifurcation at each end; said strip being folded at one end at the bifurcation to form a side wall and a pair of opposing contact blades for receiving a terminal pin therebetween; the bifurcation at the other end of said strip forming a pair of cutting blades having opposing cutting edges for receiving an electrical conductor and for cutting through the conductor insulation and into electrical contact with the conductor metal; and a spring tab extending outwardly from one of said pair of cutting blades having a portion in the plane of said last-mentioned blade and a portion raised from said plane, said last-mentioned portion being deflectable toward said plane for providing a spring action urging of one part of said connector into locking engagement with another part of said connector.

8. An electrical connector construction comprising a receptacle housing having a first face and a second, opposite face and a slotted cavity opening on said first face, said cavity having outer walls and being centrally divided by a shelf extending transversely thereacross, said housing further having a first and a second row of apertures extending from said cavity to said second face on respective sides of said shelf and a transverse slot in each of said outer walls of said cavity to present a pair of detent lips; a first and a second plurality of electrical contact terminals fitted respectively in said first and second row of apertures, each of said contact terminals comprising: a pair of opposing contact blades presenting a terminal pin socket at said housing second face; a pair of opposing conductor seizing blades at said housing cavity lying on one surface of said shelf and protruding therefrom; and a tab spring extending therefrom in the direction of said cavity outer walls; and a comb plug member dimensioned for insertion in said housing cavity, said plug member having a first and an opposite surface adapted to parallelly arrange conductors extending in a direction external from said connector construction, said plug member further having a first and a second row of fingers extending therefrom for positioning said conductors therebetween in registration with said conductor seizing blades of said contact terminals, the fingers of each of said rows of fingers each being terminated in a pawl, the pawls of the fingers of one row being directed outwardly and oppositely to the pawls of the fingers of the other row; said tab springs of said contact terminals urging associated ones of said plug member fingers toward and locking into engagement the pawls of said fingers with said detent lip of one of said housing slots as said plug member is inserted in said housing cavity.

9. An electrical connector construction as claimed in claim 8 in which said conductors are positionable in a first direction from said first surface of said plug member to said opposite surface of said plug member and in a second direction from said opposite surface to said first surface.

10. An electrical connector construction as claimed in claim 9 in which said first direction and said second direction are each at substantially right angles to said direction external from said connector construction.

11. An electrical connector construction as claimed in claim 9 in which at least one of said conductors extends beyond said first and said opposite surface of said plug member for electrical interconnection external to said electrical connector construction.

12. An electrical terminal pin receptacle for a connector assembly comprising a housing having a first face and a second, opposite face and a slotted cavity opening on said first face for receiving a conductor supporting plug, said housing further having a plurality of apertures extending from said cavity to said second face, a plurality of electrical contact terminals fitted respectively in said plurality of apertures, each of said terminals comprising an elongated flat strip having a bifurcation at each end, said strip being folded over at the bifurcation at one end to present a pair of opposing contact blades and a side wall forming a terminal pin socket at said housing second face, and a pair of opposing conductor seizing blades formed by said bifurcation at the other end extending into said cavity; and means for receiving and locking in place a conductor supporting plug comprising a transverse slot in one wall of said cavity to present a detent lip, each of said contact terminals further comprising a tab spring extending therefrom in the direction of said detent lip at said housing first face, said detent lip and said tab springs clasping a plug therebetween as said plug is inserted in said housing cavity.

13. An electrical terminal pin receptacle for a connector assembly comprising a housing having a first face and a second, opposite face and a slotted cavity opening on said first face for receiving a conductor supporting plug, said cavity having outer walls and being centrally divided by a shelf formed internally in said housing and extending transversely thereacross, said housing further having a first and a second row of apertures extending from said cavity to said second face on respective sides of said shelf, a first and a second plurality of electrical contact terminals fitted respectively in said first and second row of apertures, each of said terminals comprising an elongated flat strip having a bifurcation at each end, said strip being folded over at the bifurcation at one end to present a pair of opposing contact blades and a side wall forming a terminal pin socket at said housing second face, and a pair of opposing conductor seizing blades formed by said bifurcation at the other end extending into said cavity and lying on respective surfaces of said shelf; and said housing further comprising means for receiving and locking in place a conductor supporting plug comprising a transverse slot in each of said outer walls of said cavity to present a pair of detent lips, each of said contact terminals further comprising a tab spring extending therefrom in the direction of said detent lips at said housing first face, said detent lips and said tab springs clasping portions of a plug therebetween as said plug is inserted in said housing cavity.

* * * * *